US005819496A

United States Patent [19]

Sperber

[11] Patent Number: 5,819,496

[45] Date of Patent: Oct. 13, 1998

[54] CONTAINING INSULATION USING A BARRIER ASSEMBLY THAT INCLUDES A SUBSTANTIALLY AIR IMPERMEABLE LAYER

[76] Inventor: Henry Sperber, 8 Red Fox La., Englewood, Colo. 80111

[21] Appl. No.: 848,571

[22] Filed: Apr. 28, 1997

[51] Int. Cl.[6] ..... E04B 1/00

[52] U.S. Cl. ..... 52/742.13; 52/404.1

[58] Field of Search ..... 52/404.1, 742.13

[56] References Cited

U.S. PATENT DOCUMENTS

| | | | |
|---|---|---|---|
| 1,923,195 | 8/1933 | Finck | 20/4 |
| 4,177,618 | 12/1979 | Felter | 52/743 |
| 4,224,773 | 9/1980 | Schworer | 52/315 |
| 4,385,477 | 5/1983 | Walls et al. | 52/743 |
| 4,471,591 | 9/1984 | Jamison | 52/309 |
| 4,487,365 | 12/1984 | Sperber | 239/8 |
| 4,712,347 | 12/1987 | Sperber | 52/404 |
| 4,829,738 | 5/1989 | Moss | 52/743 |
| 4,988,406 | 1/1991 | Nelson | 156/73.6 |
| 5,131,590 | 7/1992 | Sperber | 239/8 |
| 5,287,674 | 2/1994 | Sperber | 52/743 |
| 5,365,716 | 11/1994 | Munson | 52/743 |
| 5,379,568 | 1/1995 | Murray | 52/743 |
| 5,421,922 | 6/1995 | Sperber | 156/71 |

*Primary Examiner*—Creighton Smith
*Attorney, Agent, or Firm*—Sheridan Ross P.C.

[57] ABSTRACT

A method of insulating a building assembly is provided. The building assembly includes a building structure with cavities. Netting material overlies the building cavities. Insulation particles are received behind the netting material. An air barrier layer is formed by spraying a material composition over the netting material. The air barrier layer covers the netting holes, as well as apertures that might be created when the netting material is connected to the building structure. The building assembly that includes the air barrier layer provides increased resistance to the passage of air through the building assembly and thereby provides greater insulation.

14 Claims, 4 Drawing Sheets

CONTAINING INSULATION USING A BARRIER ASSEMBLY THAT INCLUDES A SUBSTANTIALLY AIR IMPERMEABLE LAYER

FIELD OF THE INVENTION

The present invention relates to an apparatus and method for retaining insulation particles and, more particularly, to an air barrier layer that is sprayed over insulation retaining material.

BACKGROUND OF THE INVENTION

The installing of insulation into a building can take different forms and involve a variety of methods. According to one general classification of processes for insulating a building, insulation particles are blown into a wall, floor and/or ceiling construction. The insulation particles are held within such building constructions by means of an insulation retention structure. In one previously devised invention, a netting material is used to hold the insulation in the building cavities. The netting material includes a number of netting holes that permit air to escape as the cavity behind the netting material is being filled with loose insulation particles. After the proper volume of insulation has been received by the building assembly, drywall is connected over the netting material.

It is also known to attach an impervious layer to the building construction that is to receive loose fill insulation particles. Openings are created in such an impervious layer. A hose is inserted through the openings and insulation particles are blown into the building cavity behind the impervious layer. The impervious layer, however, does not readily allow for the escape or displacement of air as the insulation particles are being received into the building cavity.

A layer that acts as an air barrier has beneficial insulation properties. It is also advantageous to allow the displacement of air through netting holes as insulation particles are filling a body cavity behind the netting material. It would, therefore, be worthwhile to devise a method and apparatus that provides an air barrier layer in combination with netting material in order to retain loose fill insulation while providing increased resistance to the passage of air thereby enhancing the insulation properties of the resultant building construction.

SUMMARY OF THE INVENTION

In accordance with the present invention, a method for installing loose fill insulation particles is provided. A building assembly is constructed that can include a wall, floor, and/or ceiling structure. Such a building assembly includes building cavities defined by such a structure for receiving insulation particles that are to be blown into such cavities. A netting material having netting holes is attached to the building assembly. More specifically, studs or other boards that comprise the building assembly have the netting material attached to them using connectors, such as construction grade staples. The studs and wall, floor or ceiling boards, together with the netting material, define the building cavities that are to receive the insulation particles. For each building cavity, an opening is created that is large enough to receive a conventional hose that delivers loose fill insulation particles under pressure. The opening is usually created by enlarging or severing the regular pattern of netting holes at suitable locations in the netting material. The hose, or a nozzle attached to the end of the hose, is positioned in the created opening in the netting material. Loose fill insulation particles can then be supplied under pressure using the hose, with the insulation particles being output from the free end of the hose or the nozzle into the building cavity thereby filling it with insulation particles. Upon completion of the filling of such building cavities with insulation particles, an air barrier layer is then formed, which overlies or is disposed outwardly of the netting material. The air barrier layer covers the netting holes, as well as any opening that was formed in the netting material through which the hose was inserted. In the preferred embodiment, the air barrier layer is formed by a spraying process using a nozzle that may be, but need not be, different from the nozzle used when the loose fill insulation particles are supplied to the building cavities behind the netting material. A hose connected to such a nozzle for delivering of the material that forms the air barrier layer is different from the hose that supplies the insulation particles to the nozzle for outputting behind the netting material. The air barrier layer is preferably comprised of an adhesive that has some color or tint so that the resulting air barrier layer can be observed or visualized by the operator, who is controlling the spraying of this air barrier layer. Such visualization is useful in determining whether or not a sufficiently thick barrier layer has been provided over the netting material. After the air barrier layer has been created by spraying, it can be covered by commonly employed building materials, such as drywall that is connected to a building wall assembly.

After the above-described process is completed, an insulated building assembly is provided that includes a number of layers, each of which is separately established. The netting material with netting holes initially retains the loose fill insulation particles, while permitting the passage or displacement of air. The air barrier layer is separately formed over the netting material for achieving enhanced insulation properties in the building assembly.

Based on the foregoing summary, a number of salient features of the present invention are readily discerned. A building assembly and process for making the assembly are disclosed in which desired functional characteristics are maintained, while increasing the resulting insulation properties by providing a further insulation layer. More specifically, netting material having its desirable attributes is utilized while incorporating an additional layer for reducing unwanted air passage or flow through the building assembly. The method and apparatus covers netting holes and any openings that were made for the blowing of the insulation particles. Moreover, the air barrier layer also covers or plugs apertures in the netting material that are created due to the connectors or staples that hold the netting material to the building assembly. The additional air barrier layer is relatively easy to install and is further characterized by the ability of the operator to observe the sprayed air barrier layer in order to determine when this layer has been properly applied over the netting material.

Additional advantages of the present invention will become readily apparent from the following discussion, particularly when taken together with the accompanying drawings.

DETAILED DESCRIPTION

Figure 1:
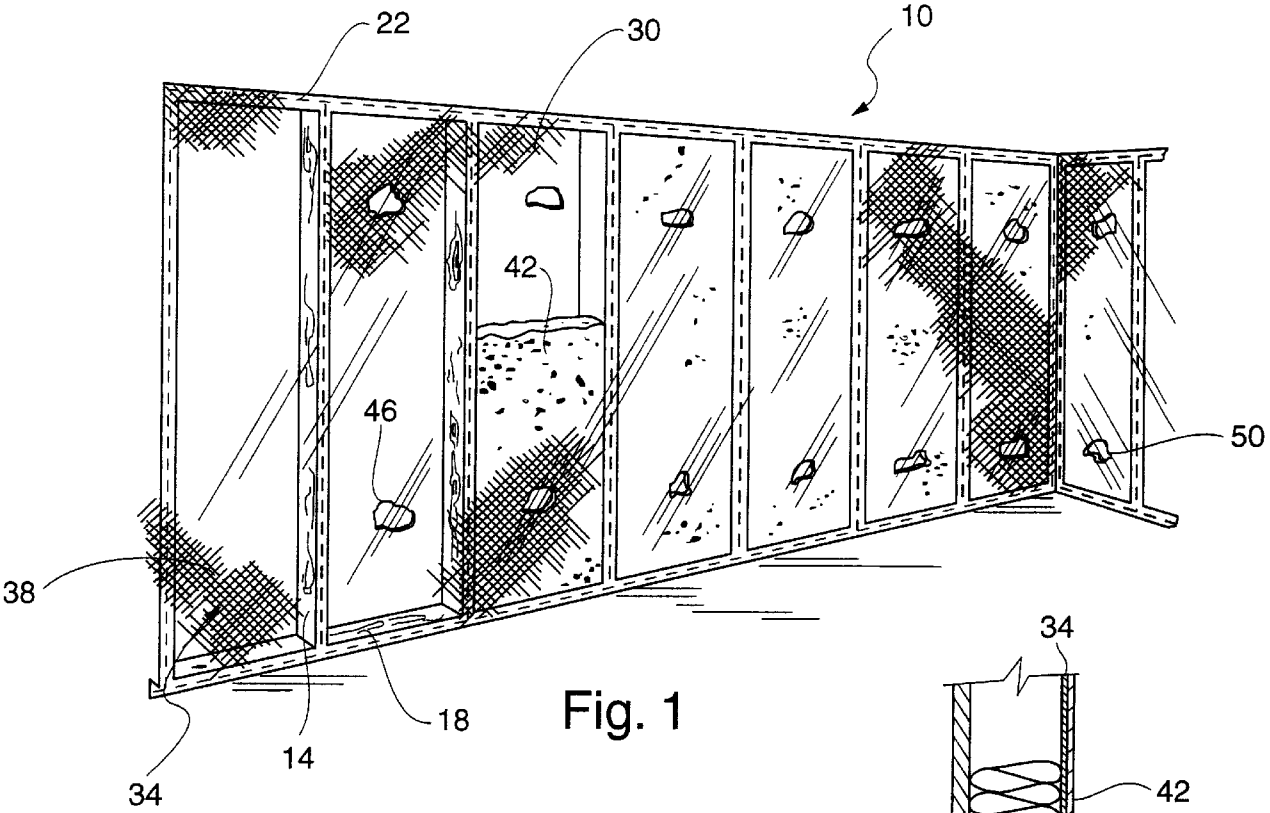
FIG. 1 is a perspective view that illustrates a building assembly constructed in accordance with the present invention.

With reference to FIG. 1, a building assembly 10 is disclosed that is insulated using the method of the present invention. The inventor of the present invention has previously devised method and apparatus related to the present invention and which subject matter is found in the following U.S. patents, with each being incorporated herein by reference:

U.S. Pat. No. 4,487,365 issued Dec. 11, 1984;

U.S. Pat. No. 4,712,347 issued Dec. 15, 1987;

U.S. Pat. No. 5,131,590 issued Jul. 21, 1992;

U.S. Pat. No. 5,287,674 issued Feb. 22, 1994; and

U.S. Pat. No. 5,421,922 issued Jun. 6, 1995.

As seen in FIG. 1, the building assembly 10 of the illustrated embodiment is a wall construction that includes a number of vertically extending studs 14 that are mounted between lower joists 18 and upper joists 22. An outer wall 26 is connected to the studs 14 and the lower, upper joists 18, 22. The outer wall 26 abuts the outwardly facing sides of the studs and the lower, upper joists 18, 22. A number of building cavities or wall spaces 30 are defined between each adjoining pair of studs 14 and extend inwardly towards the interior of the building from the outer wall 26.

Figure 2:
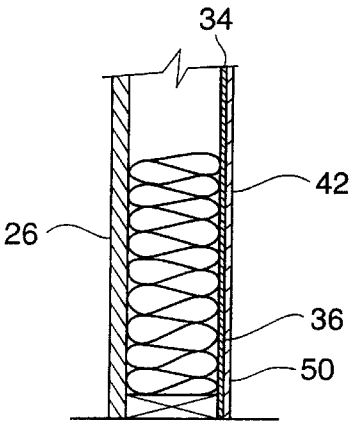
FIG. 2 is a side elevational view of the building assembly of FIG. 1.
Figure 3:
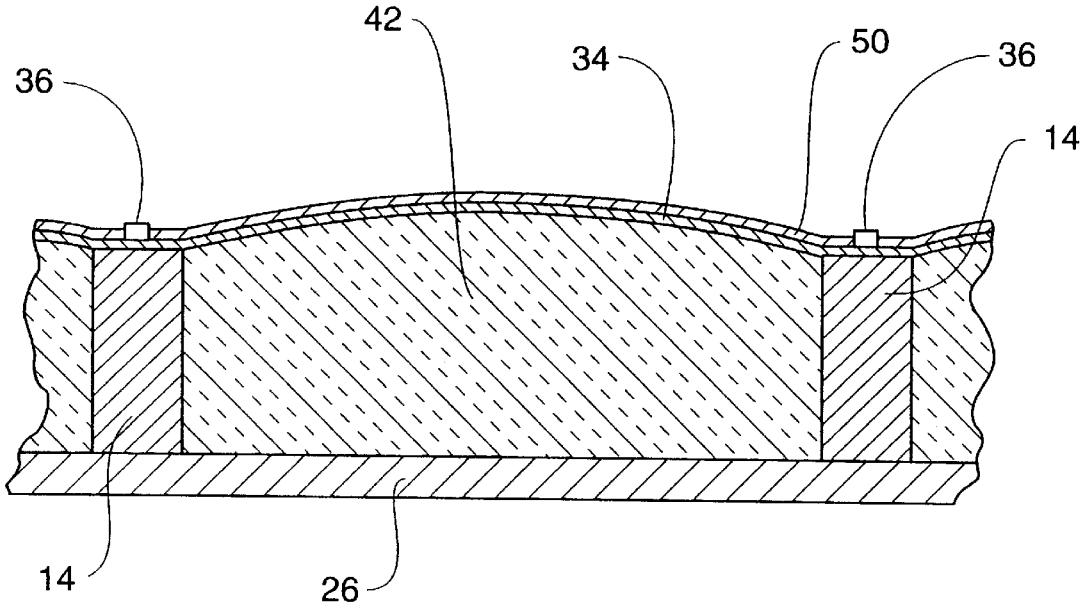
FIG. 3 is an enlarged top view of the building assembly of FIG. 1.
Figure 4:
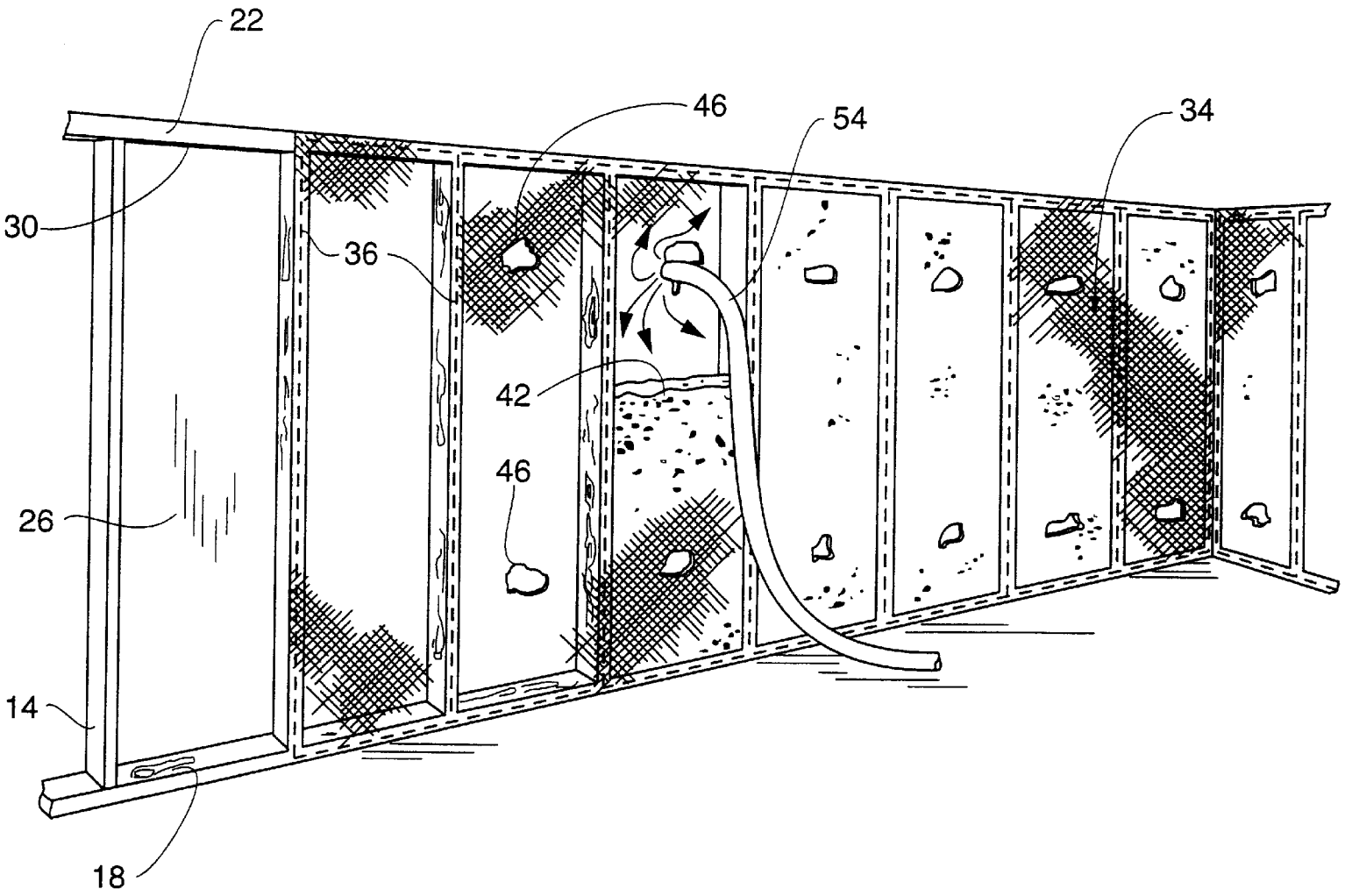
FIG. 4 is a perspective view illustrating the building assembly having netting material attached with staples and the blowing in of insulation particles before formation of the air barrier layer.

With reference to FIGS. 2 and 3, as well as FIG. 1, netting material 34 is attached to the studs 14, lower joists 18 and upper joists 22 and extends across a number of building cavities 30 of the building assembly 10. The netting material 34 is attached to the inwardly facing sides of the studs 14, lower joists 18 and upper joists 22 by connectors 36, such as staples or the like. The netting material 34 has a number of netting holes 38 that are regularly interspersed among the netting material and typically constitute more surface area than the netting material 34. The building assembly 10 also has loose fill insulation particles 42 that have been blown in under pressure or otherwise supplied to the building cavities 30 using a conventional or well-known machine that delivers insulation particles under pressure through a hose. In that regard, the netting material 34 has enlarged openings 46 formed therein for the purpose of receiving the outlet member, such as a hose or nozzle, that carries and outputs the loose fill insulation particles. After the netting material 34 is attached to the studs 14, lower joists 18 and upper joists 22, one or more openings 46 are formed in the netting by enlarging the netting holes 38, for example, so that the output mechanism can be received through the netting material 34. In another embodiment, instead of a single layer of netting material 34, the netting material can be comprised of laminated layers, as described in U.S. Pat. No. 5,287,674 which was incorporated by reference herein. The building assembly 10 also includes an air barrier layer 50 that overlies and is joined to the netting material 34. As discussed later herein, the air barrier layer 50 is formed by spraying a flowable material over the netting material 34 after the insulation particles 42 have been received within the building cavities 30 that are being covered by the layer 50. In one embodiment, the sprayed material composition that forms the air barrier layer 50 includes an adhesive made, for example, from animal glues, polyvinyl acetate, ethylvinyl acetate, or the like. Other material compositions can be utilized to form the air barrier layer 50 including a binder identified as AIRE-BLOC™ and available from a company identified as Abiff in Denver, Colo. Preferably, the material composition of the barrier layer 50 has a color or tint that can be seen by the operator or user that is applying the layer 50 so that the operator can determine, based on observation or visualization, when sufficient thickness of the air barrier layer 50 is present. After curing or hardening, the air barrier layer 50 can then be covered with conventional building materials, such as drywall.

Figure 5:
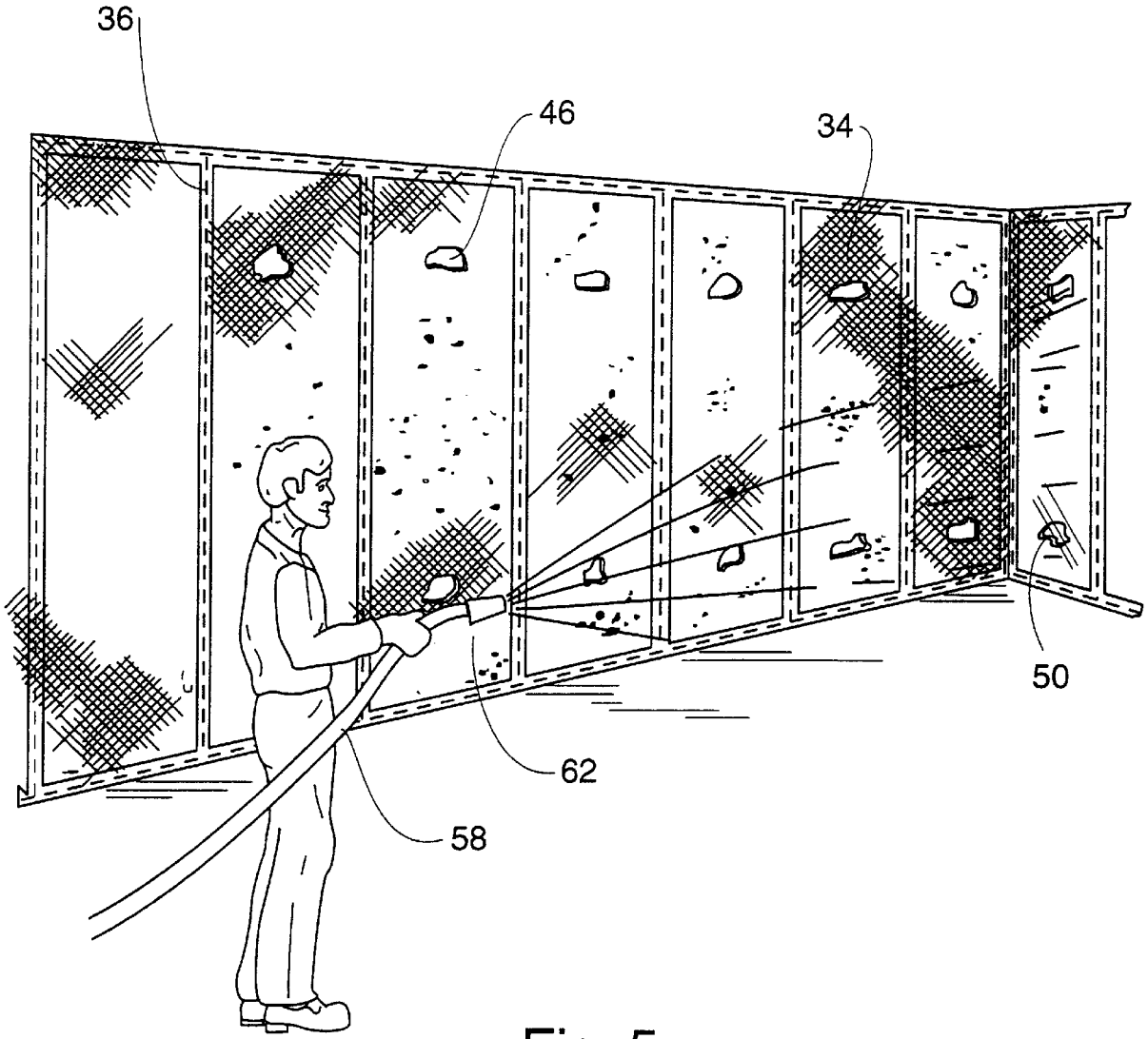
FIG. 5 is a perspective view illustrating the formation of an air barrier layer by means of spraying a suitable material.

With reference to FIGS. 5 and 6, more details of the process of the present invention are illustrated and described. FIG. 5 illustrates the blowing in of insulation particles 42 using a hose 54 through one of the openings 46 formed in the netting material 34. As described in U.S. Pat. No. 4,712,347, which was incorporated herein by reference, a determination can be made by the operator as to when sufficient insulation particles 42 have been received behind the netting material 34, particularly by means of the observation of the bulge or bowing out of the netting material 34, as illustrated in FIG. 3. After a umber of such building cavities 30 have been filled with the insulation particles 42, the method of the present invention includes the separate step of providing or forming the air barrier layer 50. As seen in FIG. 5, the operator sprays the material composition over the netting material 34 using a hose 58 and a nozzle 62 connected at the end of the hose 54. The nozzle 54 is, preferably, different from any nozzle used in supplying the insulation particles 42 behind the netting material 34. The sprayed material composition that results in the air barrier layer 50 relatively quickly hardens or cures to form a solid layer that increases the resistance to air passage or flow through the building assembly that includes the air barrier layer 50. In forming the layer 50, the netting holes 38 and the openings 46 are covered with a sufficient thickness to achieve the desired functionality of acting as an air barrier. In one embodiment, the thickness of the layer 50 is different from the thickness of the netting method 34 and, preferably, less than the thickness of the netting material. The sprayed material composition also acts to cover perforations or holes that provide access to the insulation particles 42 past the netting material 34 by covering such perforations or holes. In one embodiment, the air barrier layer 50 completely covers or encompasses such connectors 36, but need not totally cover them so long as the desired air barrier function is achieved. During the spraying of the material composition to form the air barrier layer 50, some of this barrier composition passes or seeps into the insulation particles 42 contained within the building cavities 30. Regardless, the operator is able to observe the material composition as it covers the netting material 34 including the netting holes 38 to achieve the suitable thickness of the air barrier layer 50. After the air barrier layer 50 has been formed, drywall or other building materials can be substantially immediately connected to the studs 14 and the lower, upper joists 18, 22 since little time is required for the desired hardening of the air barrier layer 50.

In addition to the air barrier layer 50, a vapor barrier can also be formed over the netting material 34. The vapor barrier is intended to prevent or reduce the passage of moisture through the barrier. Like the air barrier layer 50, such a vapor barrier can be formed by spraying a vapor barrier material, such as a low permeable binder that might include polyethylene. According to one process, such a vapor barrier is formed by spraying the vapor barrier material after the spraying or formation of the air barrier layer 50. Alternatively, the vapor barrier layer could be formed at the same time, or substantially the same time, as the air barrier layer by a spraying or formation of a material or materials that provide a combination air and vapor barrier layer.

The foregoing discussion of the invention has been presented for purposes of illustration and description. Further, the description is not intended to limit the invention to the form disclosed herein. Consequently, variation and modification commensurate with the above teachings, and within the skill and knowledge of the relevant art, are within the scope of the present invention. The embodiments described hereinabove are further intended to explain the best modes presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. A method for insulating a building assembly, comprising:

establishing a building structure having cavities;

attaching netting material having netting holes using connectors to said building structures;

receiving insulation particles behind said netting material in said cavities, said receiving step including completion of filling said cavities sufficiently with said insulation particles; and providing, after said receiving step including completion of filling said cavities sufficiently with said insulation particles, an air barrier layer separate from said netting material to increase resistance to passage of air through said building assembly.

2. A method for insulating a building assembly, comprising:

establishing a building structure having cavities;

attaching netting material having netting holes using connectors to said building structure;

receiving insulation particles behind said netting material in said cavities; and providing an air barrier layer separate from said netting material to increase resistance to passage of air through said building assembly, said providing step including spraying a material composition over said netting material.

3. A method, as claimed in claim 2, wherein:

said providing step includes receiving some of said material composition within said insulation particles.

4. A method for insulating a building assembly, comprising:

establishing a building structure having cavities;

attaching netting material having netting holes using connectors to said building structure;

receiving insulation particles behind said netting material in said cavities; and providing an air barrier layer separate from said netting material to increase resistance to passage of air through said building assembly, said providing step including covering said netting holes with a material composition that is sprayed.

5. A method, as claimed in claim 3, wherein:

said providing step includes covering openings in said netting materials different from said netting holes.

6. A method, as claimed in claim 3, wherein:

said providing step includes covering apertures created by said connectors, with said apertures being different from said netting holes.

7. A method for insulating a building assembly, comprising:

establishing a building structure having cavities;

attaching netting material having netting holes using connectors to said building structure;

receiving insulation particles behind said netting material in said cavities; and providing an air barrier layer separate from said netting material to increase resistance to passage of air through said building assembly, said providing step including overlying at least portions of said connectors with a sprayed material composition.

8. An insulated building assembly, comprising:

a building structure having building cavities;

netting material having netting holes joined to said building structure;

a plurality of connectors that attach said netting material to said building structure;

insulation particles received in said building cavities and in which said insulation particles are received until sufficient filling of said building cavities with said insulation particles is completed; and an air barrier layer, separate from but overlying said netting material, to increase resistance to the passage of air through said building assembly, wherein said air barrier layer overlies said netting material only after said sufficient filling of said building cavities with said insulation particles is completed.

9. An assembly, as claimed in claim 8, wherein:

said air barrier layer includes sufficient thickness to cover said netting holes.

10. An assembly, as claimed in claim 8, wherein:

said netting material includes openings and apertures are created by said connectors and in which said air barrier layer covers said openings and said apertures.

11. An insulated building assembly comprising:

a building structure having building cavities for receiving insulation particles;

netting material having netting holes joined to said building structure;

a plurality of connectors for attaching said netting material to said building structure;

insulation particles received in said building cavities; and an air barrier layer, separate from but overlying said netting material, to increase resistance to the passage of air through said building assembly, said air barrier layer including liquid material that contacts said netting material and subsequently hardens.

12. An assembly, as claimed in claim 11, wherein:

said liquid material includes an adhesive.

13. An assembly, as claimed in claim 9, wherein:

said thickness of said air barrier layer is different from a thickness of said netting material.

14. An assembly, as claimed in claim 13, wherein:

said thickness of said air barrier layer is less than said thickness of said netting material.

* * * * *